United States Patent [19]

Collins

[11] 3,935,604

[45] Feb. 3, 1976

[54] SUPPORT DEVICE FOR LIFTING AND SUPPORTING PATIENTS

[76] Inventor: Robert A. Collins, 10632 Baton Rouge Place, Northridge, Calif. 91324

[22] Filed: June 10, 1974

[21] Appl. No.: 477,767

[52] U.S. Cl. ..... 5/90; 5/91; 5/61; 4/113

[51] Int. Cl.[2] ..... A61G 7/02

[58] Field of Search ..... 5/61, 90, 91, 327; 4/112, 4/113, 142; 128/33

[56] References Cited

UNITED STATES PATENTS

| | | | |
|---|---|---|---|
| 3,447,071 | 11/1969 | Emerson | 5/61 |
| 3,492,988 | 2/1970 | De Mare | 128/33 |
| 3,546,716 | 12/1970 | Laumann | 4/112 |
| 3,605,138 | 9/1971 | Tucker | 5/90 |
| 3,775,781 | 12/1973 | Bruno et al. | 5/348 |
| 3,795,021 | 3/1974 | Moniot | 5/61 X |

FOREIGN PATENTS OR APPLICATIONS

| | | | |
|---|---|---|---|
| 1,254,290 | 11/1967 | Germany | 5/90 |

*Primary Examiner*—Casmir A. Nunberg
*Attorney, Agent, or Firm*—Robert E. Geauque

[57] ABSTRACT

A support device having a flexible, non-elastic base sheet which can be positioned upon the flat surface of a bed and a plurality of separate inflatable cushions each secured along one edge to the base sheet so that said cushions provide support for the buttock and hip area of the patient as well as the legs of the patient, the cushions being individually inflatable in order to normally provide an air cushion for the patient and to raise the patient into position for use of a bedpan or into other desirable orientations. Two of the support devices can be attached together to provide support for the patient's back and shoulders in addition to the patient's buttock, hip and leg area.

14 Claims, 14 Drawing Figures

SUPPORT DEVICE FOR LIFTING AND SUPPORTING PATIENTS

BACKGROUND OF THE INVENTION

1. Field of Invention

The difficulties associated with the use of a bedpan by a bedridden patient have been earlier recognized. It is difficult for the attendants to raise the hips of such a patient and maintain the necessary elevated position while a bedpan is placed below the patient. Also, it is difficult to rotate the patient first to one side and then the other to elevate the patient onto the bedpan. After the bedpan is placed in position, the patient's weight is supported by the rim of the bedpan which is uncomfortable for the patient, particularly if the patient has damage to the spine, pelvis, hips or upper legs. At best, the use of the bedpan by the bedridden patient is very unsatisfactory and the patient is always conscious of the possibiltiy of spillage from the bedpan which would require a complete change of bedclothes and linen.

2. Description of Prior Art

It has been proposed in U.S. Pat. No. 3,728,744 to provide a single crescent or U-shaped inflatable cushion which supports the patient's hips and legs when inflated to permit the bedpan to be inserted underneath the patient. The cushion is deflated and flat when inserted under the patient and then is inflated to raise the patient to permit the bedpan to be placed between the legs of the cushion. When the use of the bedpan is completed, the bedpan is removed and the cushion must be deflated and removed fom underneath the patient.

With such a device, it is still necessary to move the patient in order to locate the cushion underneath the patient and it is necessary to move the patient to remove the cushion after the patient is finished with the bedpan. Because the cushion is a continuous, single envelope, the inflation of the cushion changes the orientation of the cushion sections with respect to the patient. In other words, with a U-shaped cushion, the crosspiece will try to lengthen tending to cause the legs to cross. On the other hand, a crescent shaped cushion will try to straighten out during inflation and the ends will tend to move apart. The tendency of the cushion to change shape during inflation makes it difficult to properly locate the cushion in flat condition under the patient so as to be in the proper position when inflated.

SUMMARY OF THE INVENTION

The device of the present invention consists of a plurality of individual, flexible, elongated cushions attached to a flat, non-elastic flexible base sheet, and the cushions can be inflated to support the hips and legs of the patient relative to a bedpan. Each cushion can be attached at only one edge to the base sheet and is separately inflated so that when the cushions change shape when inflated, the orientation of the cushion is not affected. The amount of separation of two longitudinally extending cushions at the hip and buttock area of the patient can be controlled by a cross band extending transversely of the cushions.

The device of the present invention also has the advantage that it can be continuously located under the patent whether or not the bedpan is to be used and a cover in the form of a divided draw sheet continuously covers the complete device. This cover permits free flow of air between the skin area of the patient and the waterproof cushions of the device in order to prevent irritation of the patient's skin while placed upon the device. Also, the cushions are normally inflated somewhat to continually provide an air cushion for the patient so that the patient will not develop bed sores.

A pair of devices can be used together by attaching a second device to the top of a first device used to support the first area of the patient, namely the buttock, hips and legs of the patient. This second device supports a second area of the patient, namely the back, shoulders and head of the patient, to maintain the second area at approximately the same elevation as the first area, both during normal resting and during bedpan usage.

The amount of inflation of the individual cushions can be controlled by the attendant. This permits the cushions to be inflated different amounts to vary the orientation of the patient on the bed even though the bedpan is not to be used. Such change in orientation can be accomplished to rest the patient or make the patient more accessible to the doctor. The support device of the present invention therefore provides for easier and less manipulation of the bedridden patient by the attendant when it is necessary for the patient to use the bedpan or when it is advisable to reorientate or raise the patient in bed for other reasons.

DESCRIPTION OF THE PREFERRED EMBODIMENT

Figure 1:
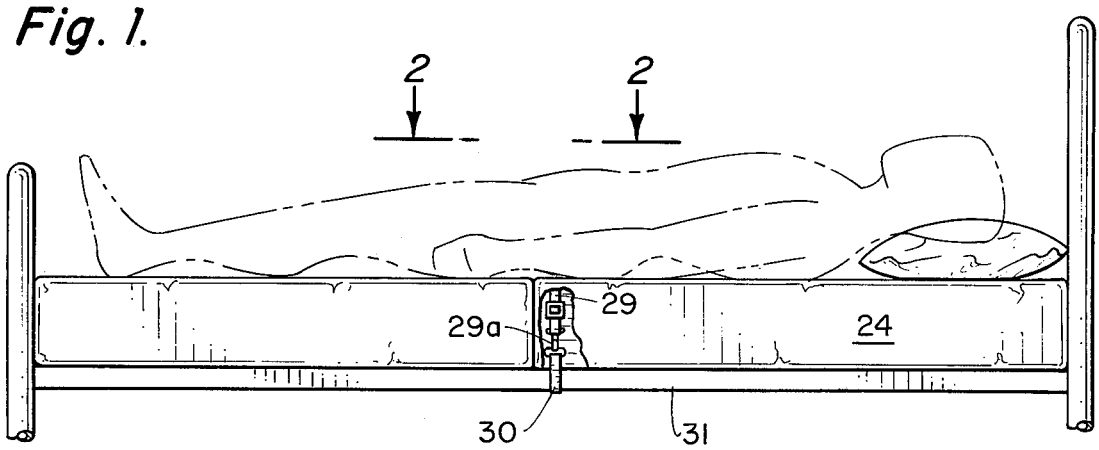
FIG. 1 is a side elevational view of the support device of the present invention in deflated condition and attached to a bed.
Figure 2:
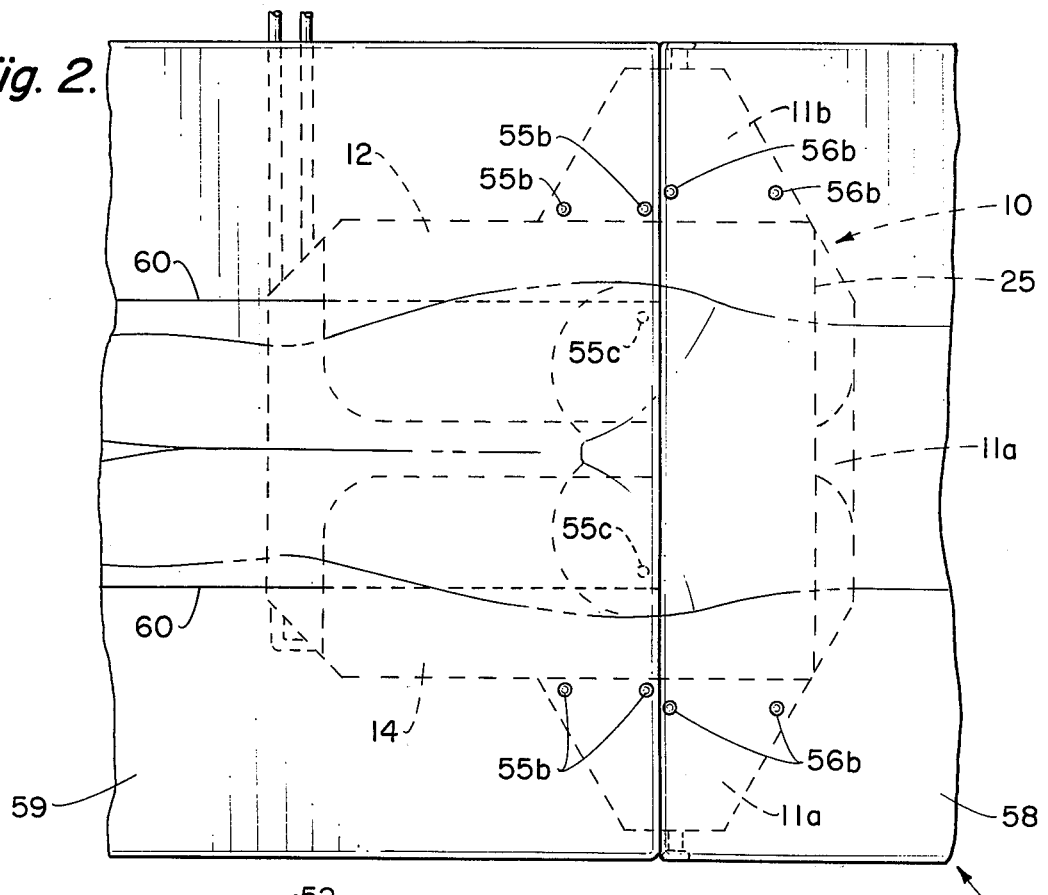
FIG. 2 is a top plan view along line 2—2 of FIG. 1 of the support device in deflated condition and covered by upper and lower draw sheets.
Figure 3:
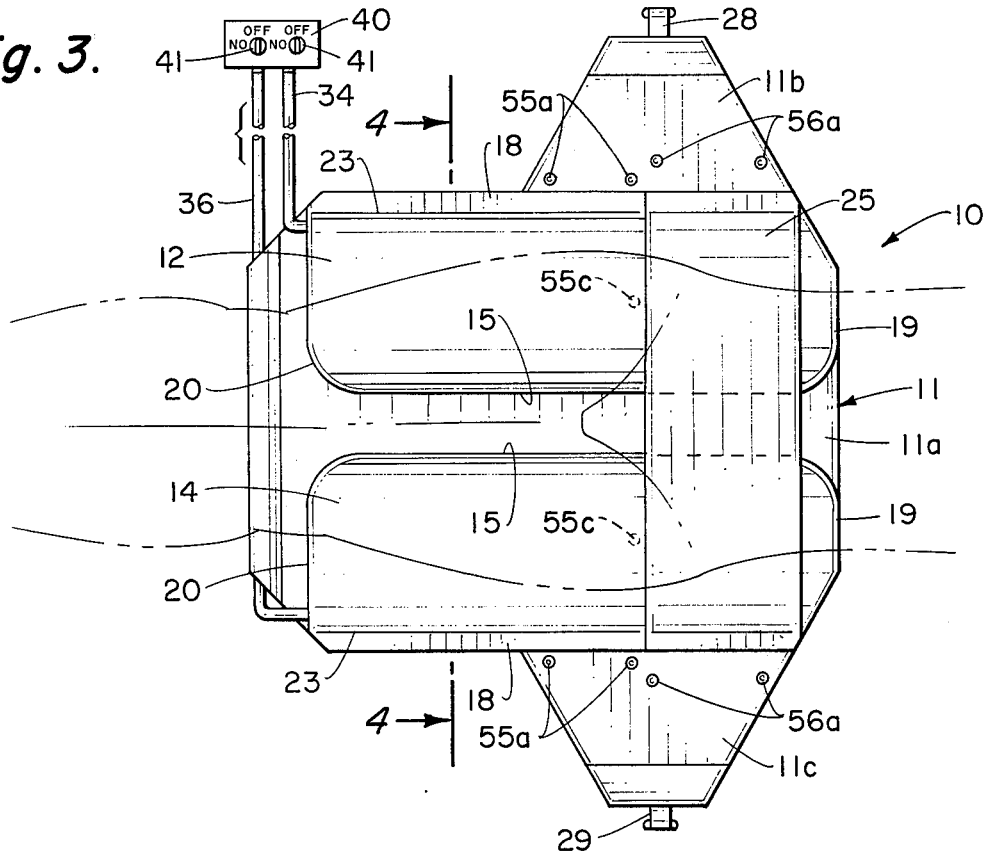
FIG. 3 is a top plan view of the support device in the normal partially inflated condition to provide an air cushion for the patient.

Referring to FIGS. 1–3, support device 10 of the subject invention comprises a flat, flexible non-elastic base sheet 11 which has a substantially rectangular center section 11*a* and trapezoidal shaped side sections 11*b* and 11*c* extending from opposite sides of the center section. Flexible cushions 12 and 14 are each fabricated of a single layer of flexible non-elastic material which is folded at inner edges 15 to produce upper and lower layers 16 and 17, respectively, see FIG. 4. The layers are connected together by suitable switching around outside longitudinal edges 18 and transverse top and foot edges 19 and 20 to form chambers 21*a* and 21*b* within the cushions 12 and 14, respectively which receive air tight flexible liners 22*a* and 22*b*, respectively.

Figure 4:
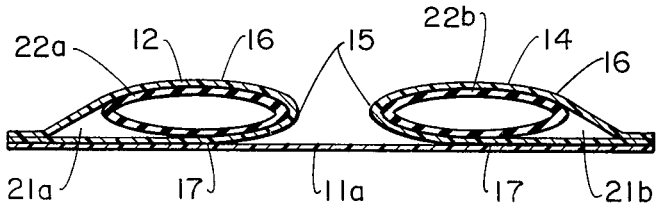
FIG. 4 is a transverse vertical section along line 4—4 of FIG. 3 showing the separation between the adjacent edges of the cushions.

The cushions 12 and 14 are stitched or otherwise secured to the base sheet 11 only along outside, longitudinal edges 18 by seams 23 located approximately at the sides of the center section 11*a* so that the cushions extend longitudinally along the base sheet 11. A flexible, rectangularly shaped cross band 25 extends transversely across the head ends of the cushions 12 and 14 and its ends are also secured to the base sheet at seams 23. As illustrated in FIG. 1, the cushions 12 and 14 initially lie flat upon the base sheet when completely deflated and the cross band 25 is substantially the same length as the distance between the two seams 23. As illustrated in FIGS. 3 and 4, the cushions 12 and 14 have been deflated to thin air cushion condition which raises the patient slightly above the mattress 24 and provides a comfortable 24 hour support for the patient when the bedpan is not in use. Straps 28 and 29 are connected at one end to side sections 11*b* and 11*c*, respectively, and have fasteners 29*a* on the opposite ends. As illustrated in FIG. 1, each fastener connects with a metal hook 30 which overlaps the frame 31 of the bed to securely hold the base sheet 11 on the mattress 24. The support device 10 can be located at any desired longitudinal position along the bed and secured in position by adjusting the length of the straps in order to hold the device to the frame 31 in taut condition.

An air conduit 34 extends through an air tight opening in edge 20 of cushion 12 and communicates with the interior of liner 22*a*. In a similar manner, air conduit 36 communicates with the interior of liner 22*b* in cushion 14. Conduits 34 and 36 extend transversely to one side of the bed and connect to valve housing 40 which contains a separate valve 42 for each conduit (see FIG. 11). As shown in FIG. 3, the housing 40 can be located on the bed or at any other convenient location and has two exterior knobs 41 to separately control the valve for each conduit.

Figure 11:
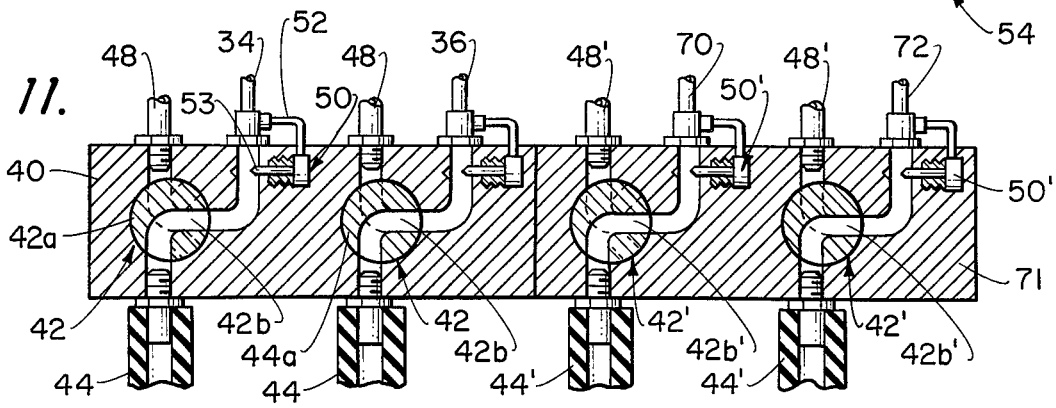
FIG. 11 is a schematic illustration of the valves and valve housings utilized to control the inflation of the cushions.

Each valve 42 is connected by a conduit 44 to a source of compressed air or gas, such as a small, electrically driven compressor. Also, each valve is connected to an air exhaust passage 48. As illustrated in FIG. 11, each valve has a rotor 42a which is moved by a knob 41 and each rotor contains a right angle passage 42*b* communicating between two openings spaced 90° apart in said rotor surface. The inlet passage 44 and exhaust passage 48 are aligned while the conduit leading to a cushion is a right angle to these passages.

With the passage 42*b* of the valve rotor in the full line position of FIG. 11, compressed air is being introduced to conduit 34 to inflate liner 22*a* and cushion 12. When the rotor is moved 45° counterclockwise to the first dotted line position, all passages 34, 44 and 48 are blocked and the compressed air in the cushion 12 is trapped. When the rotor is moved another 45° counterclockwise to the second dotted line position, the air is released from the cushion through conduit 34 and exhaust passage 48. A pressure overload valve 50 can be placed in each conduit 34, 36 to prevent the development of excess pressure in either cushion. Each overload valve can comprise a bellows located in a chamber in housing 40 and receiving the pressure in one of the conduits through passage 52. When the pressure in the conduit exceeds a predetermine value, the bellows will move needle valve 53 to closed position to disconnect the conduit from the supply conduit 44. Also, a standard blow-off valve of well known construction can be connected to each cushion to assure that excessive pressure will be released from the cushion. From the above description, it can be seen that the valve for each cushion can be manipulated to inflate the cushion by any desired amount to maintain the desired inflation and to exhaust the cushion when desired. It is apparent that the described valve system is only illustrative of a number of valve constructions that could be utilized to control and maintain the inflated condition in each cushion in the desired manner.

Figure 6:
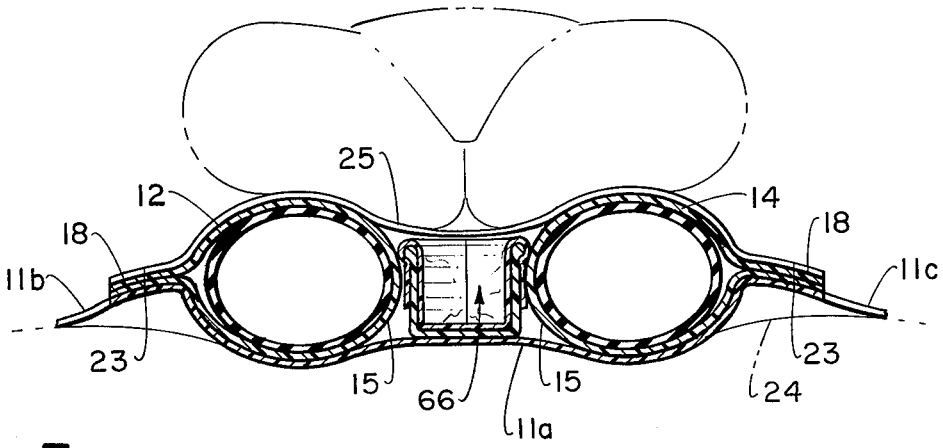
FIG. 6 is a transverse vertical section along line 6—6 of FIG. 5 showing the separation between the adjacent edges of the cushions to receive the bedpan.
Figure 7:
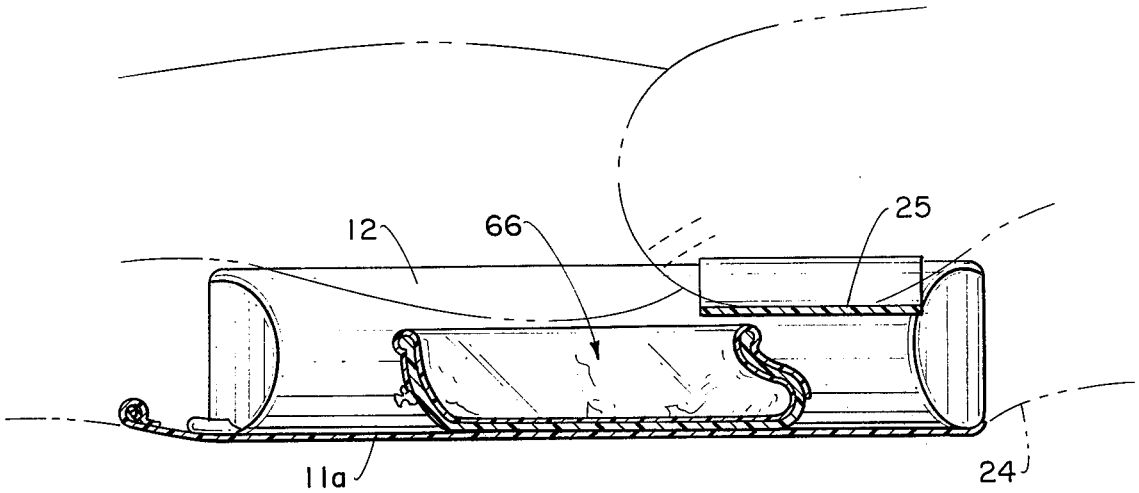
FIG. 7 is a section along line 7—7 of FIG. 5 showing the cross band.
Figure 8:
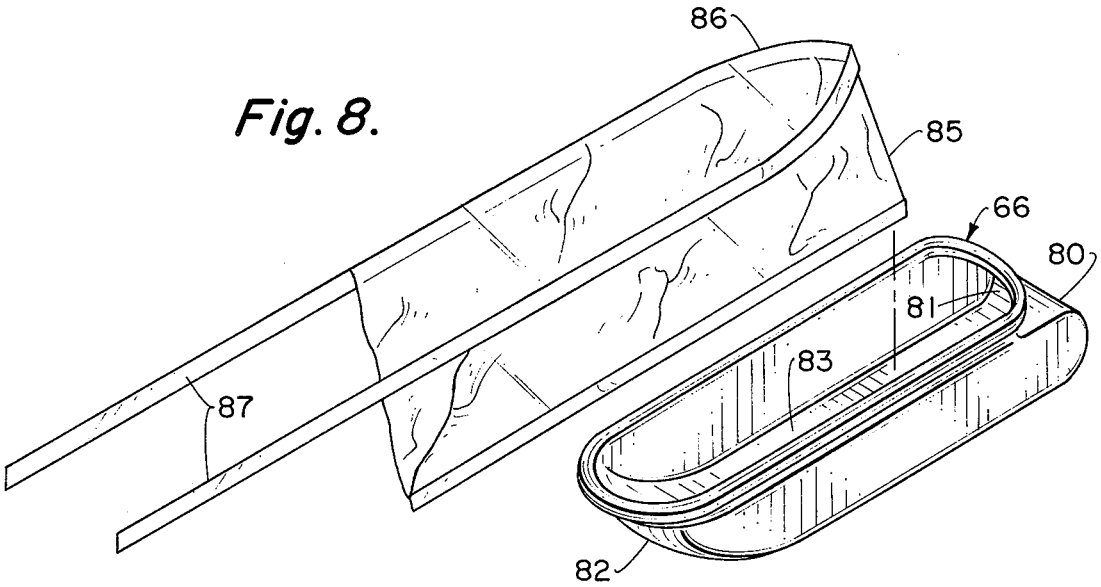
FIG. 8 is a perspective view of the bedpan and of the disposable plastic liner for the bedpan.

When both cushions 12 and 14 are fully inflated, the band 25 becomes taut against the cushions and the cushions become slightly depressed into the mattress 24 as illustrated in FIGS. 6 and 7. The cross band provides a raised support area for the sacro-iliac, buttock and hip areas of the patient and each cushion provides support for one of the patient's legs.

Figure 5:
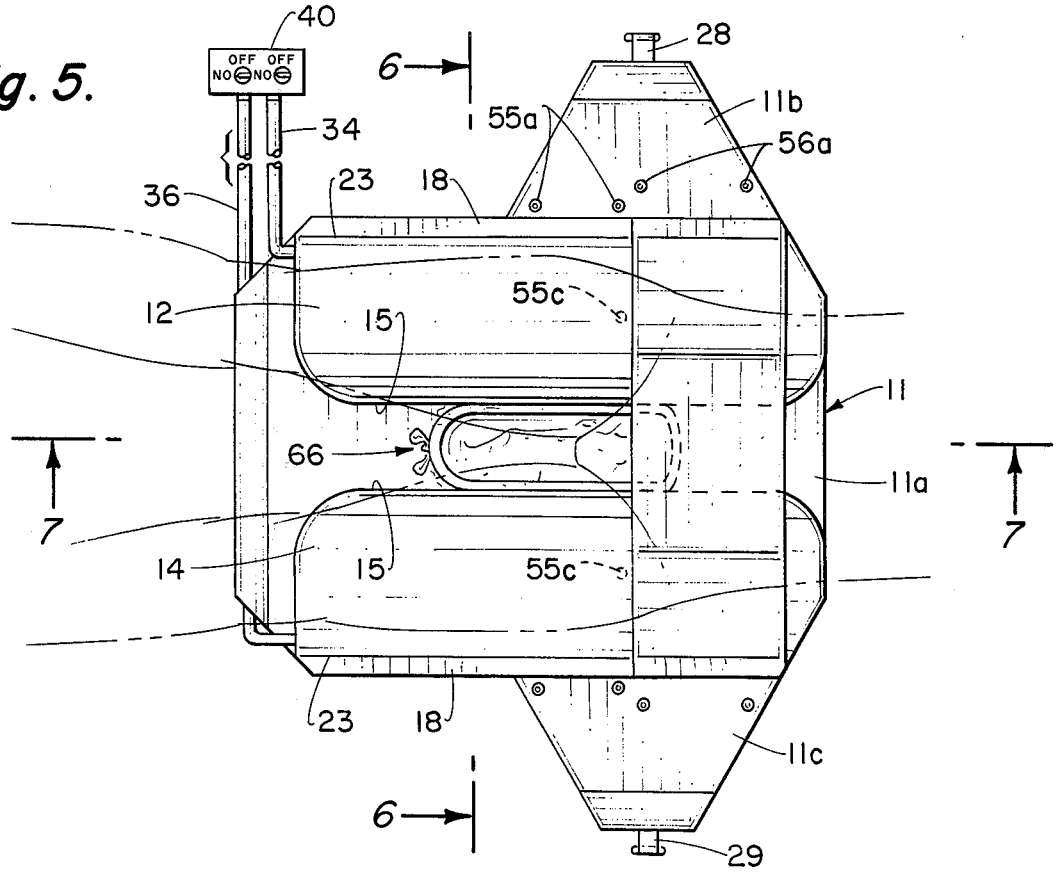
FIG. 5 is a top plan view of the support device in full inflated condition with the bedpan in place.

As illustrated in FIGs. 3 and 5, the support device 10 need not be covered when it is placed on the surface of the bed and the patient can lie directly upon the support device in both inflated and deflated condition. However, it is preferable to provide a cover 54 which is placed over the support device and is fabricated from a sheet material. Referring to FIGS. 2 and 3, the side sections 11*b* and 11*c* each have a lower set of two snap portions 55a and an upper set of two snap portions 56*a*. The cover 54 comprises two separate draw sheets 58 and 59. The top draw sheet 58 has snap portions 56*b* which connect with snap portions 56*a* on the side sections in order to place the bottom edge of the top sheet at the lower edge of cross band 25. The lower draw sheet 59 has snap portions 55*b* which connect with a snap portion 55*a* on the side sections so that the top edge of the lower sheet 59 meets the bottom edge of the top sheet 58. The two draw sheets overlap the opposite ends of the bed and both sides of the bed in order to completely cover the support device 10 and separate the skin of the patient from the device. Thus, free flow of air is permitted between the skin of the patient and the support device in order to prevent or cure body sores. The bottom draw sheet 59 tucks under the inner edge of each longitudinal cushion and folds at line 60 so that it will hug tightly against the cushions during inflation and and deflation of the support device. Snaps 55*c* on the top surface of the base sheet and inner surface of the cushions are provided to secure the tucks.

When it is desired that the patient use bedpan 66, both cushions 12 and 14 are fully inflated as shown in FIGS. 5 and 6. Upon full inflation, each cushion tries to assume a circular cross section (see FIG. 6) and since the outside edge 18 of each cushion is secured to the base sheet and the base sheet side sections 11*b* and 11*c* are tightly secured to the bed, the inner edges 15 of the cushions move apart to provide space for the bedpan. Also, the cushions 12 and 14 depress somewhat into the surface of mattress 24 and the area at seams 23 raise somewhat above the mattress surface as shown in FIG. 6 due to the inflation of the cushions. The bedpan 66 is easily inserted between the cushions 12 and 14 and extends slightly underneath the cross band 25 as illustrated in FIG. 5. Since the buttock and hip area of the patient are originally located in proper position when the device is deflated, the patient will be in proper position for use of the bedpan after the cushions are inflated and it is not necessary to further move the patient by any appreciable amount after full inflation. Since the patient's buttock and hip area are resting on cross band 25 and the patient's legs are supported by cushions 12 and 14, the patient will not be resting on the bedpan while it is being used. As indicated in FIG. 6, it is desirable to locate the crouch of the patient just below the lower edge of cross band 25 so that the discharge from the patient will be at a location to be completely received by the bedpan 66 without soiling the cover 54. While the cover 54 is not shown in FIGS. 3–6, it is understood that the cover can overlie device 10 and that the bedpan 66 would be placed upon cover 54.

Both cushions 12 and 14 are normally inflated the same amount so that the patient is positioned substantially level while using the bedpan 66. However, since the cushions 12 and 14 are entirely separate from one another, the inflation of one does not affect the inflated condition of the other and there is no tendency for the cushions to move angularly relative to one another during inflation. After use of the bedpan is completed, it can be removed and thereafter the cushion deflated so that the patient can continue to recline upon the slightly inflated cushions of FIGS. 3 and 4. It is unnecessary to remove the support device 10 from the surface of the bed after each use of the bedpan. After deflation of the cushions, it is not necessary to lift the patient or otherwise move the patient.

Figure 9:
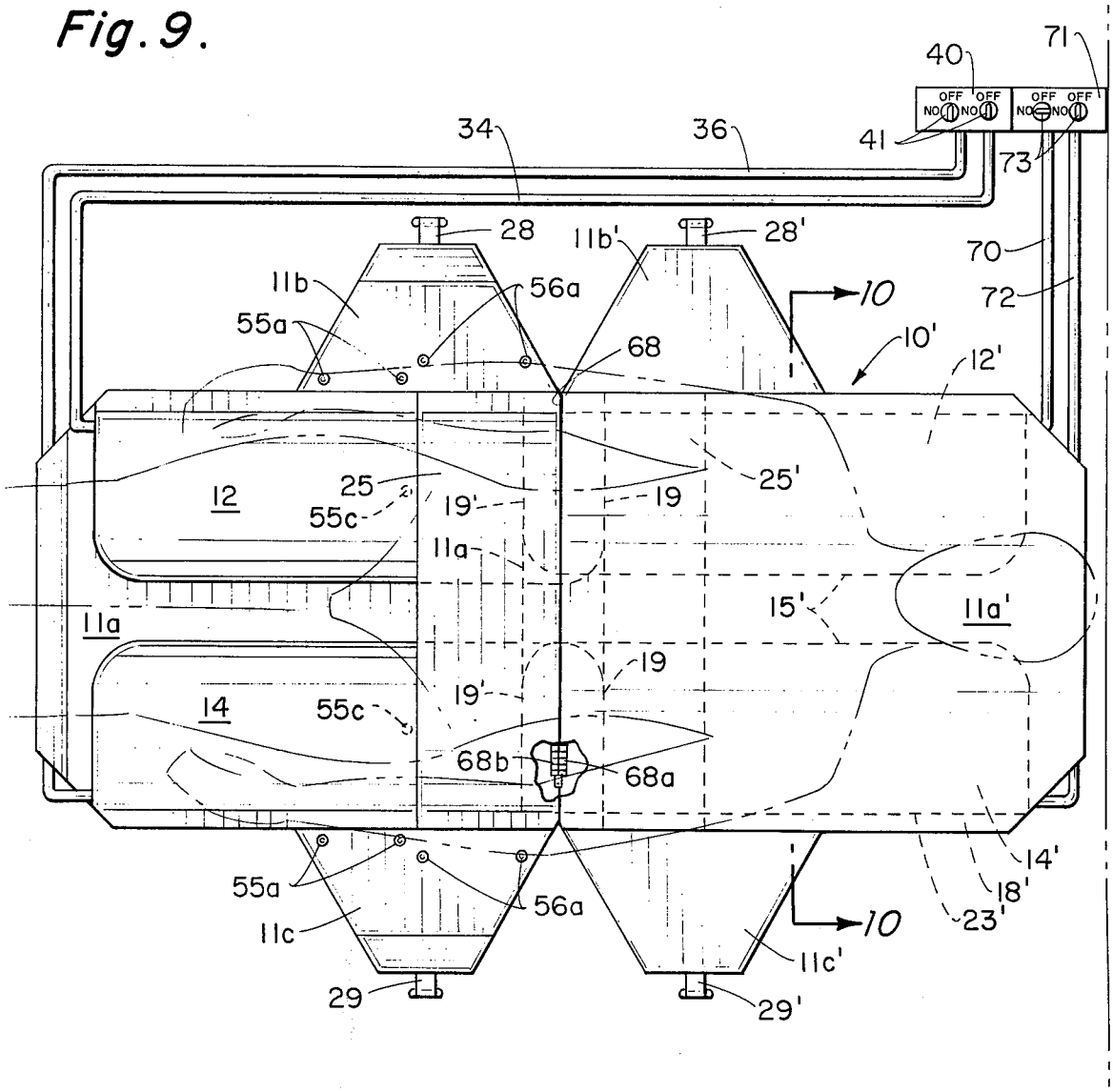
FIG. 9 is a top plan view of two support devices connected together to support the back and shoulder area in addition to the hip and leg area.
Figure 10:
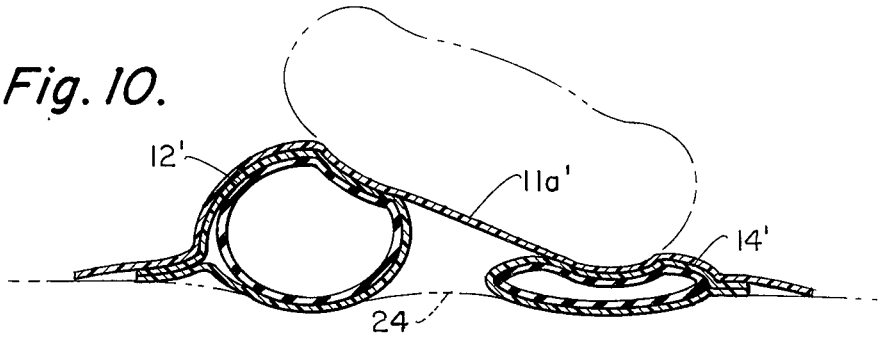
FIG. 10 is a transverse vertical section similar to FIG. 9 with inflation in the two cushions.

As illustrated in FIG. 9, a second separate support device 10' can be turned over and inverted and then attached to a device 10 as illustrated in FIG. 3. In this condition, the cushions 12' and 14' and cross band 25' of device 10' are below the base sheet section **11*a*'. A first zipper element 68a of zipper 68 is attached to the upper surface of base sheet section 11*a*' on the opposite side from cross band 25' and at a location in line with the outside edge of band 25'. A second zipper element 68*b* is attached under the outside edge of cross band 25 of device 10. When the zipper elements are positioned together, the end of device 10' projects slightly underneath cross band 25 and over the ends of cushions 12 and 14. Thus, the base sheet 11a' of device 10' is continuous with the cross band 25 of device 10 and extends to the top of the mattress 24. The device 10' has side sections 11*b*' and 11*c*' to which are attached straps 28' and 29', respectively, and these straps are secured to the rail of the bed and the same manner as the straps 28 and 29 of device 10, so that the base sheet 11' will be held tight. The cushions 12' and 14' of device 10' are constructed in the same manner as cushions 11 and 12. The inner adjacent edges 15' are folded and the outside edges 18' are stitched to the base sheet 11' along seam 23'. The band 25' is also stitched to the base sheet along seam 23' and extends across cushions 12' and 14' in the same manner as band 25 of device 10. As illustrated in FIG. 10, the back, shoulders and head of the patient rest on base sheet section 11*a*' while device 10 supports the legs, hips and buttock area in the same manner as previously described. Also, the cover sheets 58 and 59 can be attached to snap portions 55a and 56a, respectively, in order to completely cover both devices 10 and 10'**.

The cushion 12' can contain a liner (not shown) which connects with air passage 70, and passage 70 also connects with a second valve housing 71 (see FIGS. 9 and 10), which is identical in structure with valve housing 40 and can be connected thereto. Also, a conduit 72 connects with a liner (not shown) in cushion 14' and with the valve housing 71. The housing 71 contains two valve rotors 42' identical to rotor 42 which are positioned by control knobs 73. The rotors control the flow from high pressure air passages 44' to passages 70 and 72 and control the exhaust from passages 70 and 72 through passages 48. The passages 70 and 72 can contain overload devices 50' to prevent the development of excessive pressure in cushions 12' and 14'. In the full line position of valve passages **42*b*', the passages 70 and 72 are connected to air pressure in passages 44'. The valve rotors can be rotated in the same manner as rotors 42 to either block passage 70 and 72 or to connect them to exhaust passage 48'. It will be apparent that with the devices 10 and 10' connected together at zipper 68, the back, shoulders and head of the patient will be uniformly supported by continuous base sheet section 11*a*'**.

The inflation of all four chambers 12, 14, 12' and 14' can be controlled by knobs 41 and 73 to be approximately equal and thereby produce an air cushion upon which substantially the entire body of the patient will normally rest. When it is required for the patient to use the bedpan, the knobs 41 and 73 can be controlled to increase the inflation of all four cushions until they reach the inflation corresponding to FIG. 6. As previously described, in such a condition, the sacro area of the patient is in a position for comfortable use of the bedpan 66. At the same time the patient's body, shoulders and head are raised so that this portion of the body is not tilted downwardly from the hip area in an uncomfortable manner. When the draw sheets 58 and 59 are connected to device 10 as illustrated in FIG. 2, the skin surface will be fully separated from the devices to permit circulation of air over the skin. It is to be understood that the construction of device 10' is identical to the device 10 and that the device 10' is simply inverted and turned upside down relative to device 10.

It is apparent that the patient can be turned to one side of the other by simply inflating one or both of the cushions on one side of the bed. As shown in FIG. 10, the left shoulder, back and head can be rotated by the inflation of cushion 12' while leaving cushion 14' only slightly inflated. In the same manner, a hip and leg of the patient can be turned and raised while the other hip and leg remains in the normal position. It is further apparent that the entire body of the patient can be rolled to one side by inflation of both cushions 12 or 12' and to the other side by inflation of cushions 14 and 14'. Also, the body of the patient could be cyclically rotated at the pelvic are for stimulation of circulation by alternately inflating the cushion on one side of device 10 and the cushions on the opposite side of device 10'. Since bedridden patients cannot change position in bed, any change in the patient's position tends to rejuvinate the patient. It is apparent that when a cover 54 is placed over the support devices, the control knobs and associated control valve housings 40 and 71 must be located to one side of the bed in order to be available to the attendant.

In order to facilitate the ease of utilizing the bedpan 66, the bedpan can have a substantially rectangular cross section with a projection 80 at the end which is inserted under the cross band 25. This projection provides a hollow end space 81 which receives and confines the patient's discharge as the bedpan is moved away from the patient. The other end 82 of the bedpan is slanted inwardly toward the bottom 83 to facilitate the pouring of waste out of the bedpan. A thin flexible plastic liner 85 can be loosely inserted into the interior of the bedpan with the upper line band 86 overlapping the upper edge of the bedpan and secured by tie straps 87. Thus, the waste contents of the bedpan can be easily disposed of by the nurse or attendant by throwing away the liner and without the necessity of continually cleaning or sterilizing the bedpan itself.

From the above it is apparent that the cushions can be maintained at the air cushion level of FIG. 3 for the complete day except for those times in which the bedpan is used. It is important that the side straps connecting the devices 10 and 10' to the bed be non-elastic in order to cause the cushions 12 and 14 to automatically separate at the center of the base sheet and to keep the devices positioned in the center of the bed at all times, whether deflated or inflated. The side straps also produce the tension on the cross band 25 to raise the sacral area during the elevation for bedpan use. The support device will lift the patient for the bedpan function with little effort on the part of the nurse or attendant. After the toilet function is completed, the bedpan is easily slipped out from under the patient because the patient does not rest on the bedpan. Also, since the bedpan is still supported, it is easy for the nurse to clean the patient or for the patient himself to do the necessary cleaning.

A patient can remain on the device continually during his stay in the hospital since the skin is continually protected by the draw sheets against bed sores. Also, the various movements which can be imparted to the patient during his resting time can aid in the comfort and recovery of the patient since the general circulation will be greatly improved and discomfort relieved. In the absence of an attendant, the patient can be allowed to adjust the control knobs to vary the elevations of various parts of his body. In many case, the patient can, by adjusting the air pressure, carry out the entire function of the bedpan use without help from the nurse. In the case of incontinence and involuntary patients, the device can be placed under the patient and left continually inflated so that the bedpan can be left in place 24 hours a day. The nurse can occasionally check on the status of the patient to determine if cleaning has to be done. In the present device, there is no squeezing of the air from one cushion to the other since the inflation of the air cushions is separately controlled. The combined tandem unit as shown in FIG. 9 is advisable in all cases where bending of the back in any way is not advisable since the double unit allows for a level lift of the entire body, except for the feet.

Figure 12:
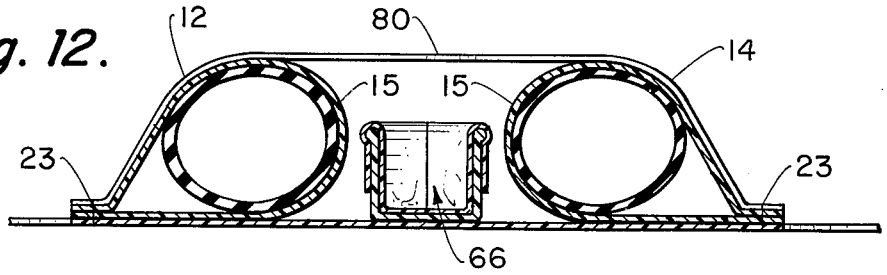
FIG. 12 is a cross sectional view similar to FIG. 6 in which the length of the cross band has been increased.

As illustrated in FIG. 12, a larger cross band 80 can replace the cross band 25. Cross band 80 is larger than the distance between side seams 23 in the base sheet so that when the cushions 12 and 14 are inflated slightly to air cushion condition, a portion of cross band 80 is left loose and flaccid. However, in the fully inflated condition of FIG. 12 (which is similar to FIG. 6) the cross band 80 becomes stretched and at the same time permits cushion 12 to roll counterclockwise and cushion 14 to roll clockwise. This movement results in increased distance between the adjacent edges 15 of the cushions at the center of the base sheet where the bedpan is received. Also, this opposite movement of the cushions 12 and 14 tend to spread the buttocks apart to facilitate the waste discharged by the patient. Because of the increase in the center space, the bedpan can be easily placed under the patient.

Figure 13:
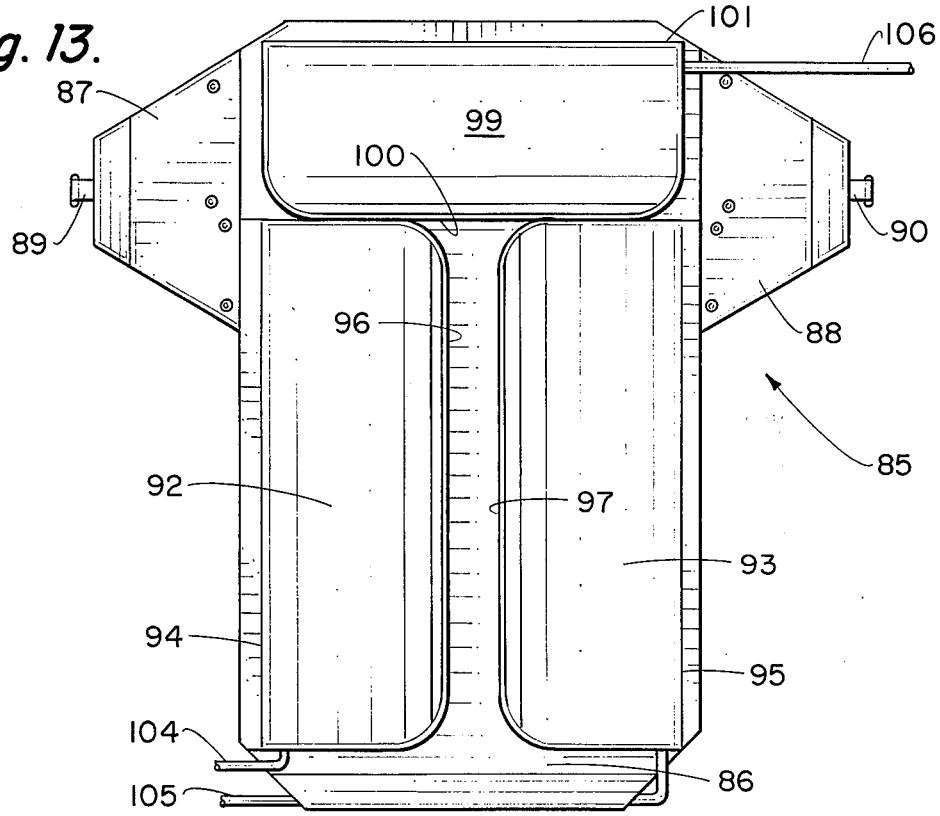
FIG. 13 is a plan view of modification using two longitudinal cushions, and one transverse cushion.

A modification 85 of the device illustrated in FIG. 13 operates generally the same as support device 10. The device 85 comprises a base sheet 86 having a side sections 87 and 88 to which bed straps 89 and 90, respectively, are secured for attachment to the frame of the bed. Two longitudinal cushions 92 and 93 are attached by stitching to the base sheet along the edges 94 and 95, respectively, opposite the folded edges 96 and 97. The cushions 92 and 93 can be air tight or can contain a liner as illustrated for cushions 12 and 14, so that the cushions can be inflated and deflated. An additional cushion 99 is located transversely across the head end of the base sheet 86 and is folded at edge 101 and stitched to the base sheet at edge 100. The end edges of cushions 92, 93 and 99 are all closed to maintain the shape of the cushions. The longitudinal cushions 92 and 93 are connected to conduits 104 and 105, respectively, and the cushion 99 is connected to conduit 106. Each of the conduits can be connected to a separate valve identical to valves 42 in a suitable valve housing (not shown) so that the inflation of the cushions can be separately controlled by the individual control knobs connected to valves.

Modified device 85 eliminates the use of a cross band 25 since the cushion 99 will be located to raise the buttock, hips of the patient to a heighth greater than the bedpan, and the cushions 92 and 93 serve to raise the legs of the patient. The adjacent edges 96 and 97 are free to move away from each other during inflation of the cushions to provide a space for the bedpan 66, in the same manner as cushions 12 and 14 move during inflation for bedpan usage. It is apparent that one or more of the cushions 94, 95 and 99 can be inflated individually or together by various amounts to change the position of the patient and to rest the patient. Cushions 92 and 93 will be shorter than cushions 12 and 14 in the longitudinal direction because of the presence of cushion 99 on the base sheet.

Figure 14:
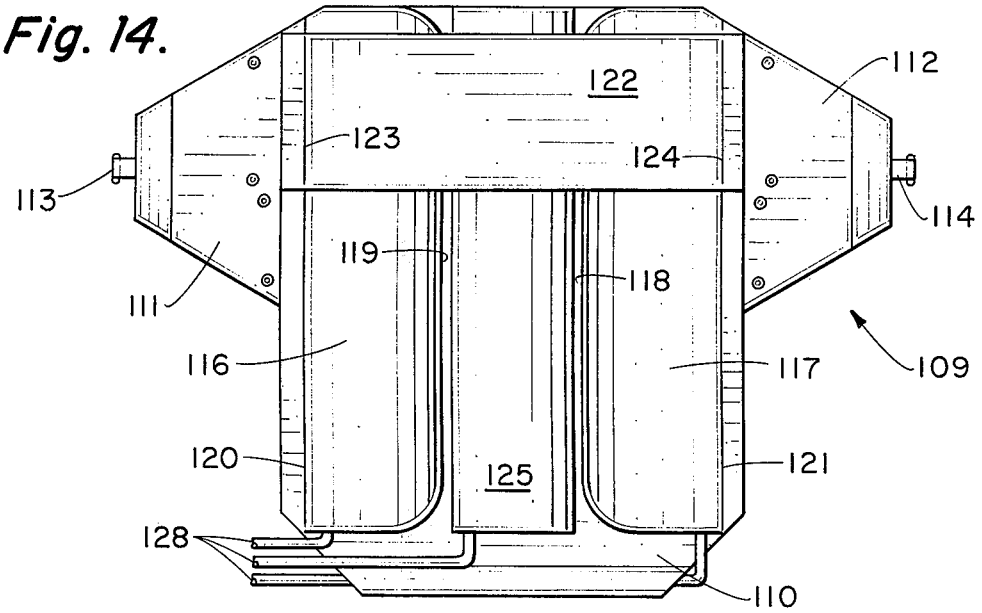
FIG. 14 is a plan view of another modification using three separate longitudinal cushions.

Another modification 109 of the device illustrated in FIG. 14 has a base sheet 110 with side sections 111 and 112 connected by straps 113 and 114, respectively, to the bed frame. Longitudinal cushions 116 and 117 are folded at edges 118 and 119 and are stitched to the base sheet along edges 120 and 121, respectively. A cross band 122 extends over the top of cushions 116 and 117 and is connected to the base sheet at edges 123 and 124. A third cushion 125 is located between the folded inside edges 118 and 119 of cushions 116 and 117, respectively, and can be stitched along the center of its bottom section to sheet 110. The cushions 118, 119 and 125 are all of the same length and each is connected by a conduit 128 to a valve housing (not shown) which contains three rotary valves identical to valves 42. The high pressure air supply is connected to the cushions through each valve so that the inflation and deflation of the cushions can be separately controlled.

Normally, all three cushions 116, 117 and 124 are inflated to the air cushion level and cover substantially the entire base sheet 110 so that the full body of the patient over the cushions is substantially uniformly supported. However, when it is desired for the patient to utilize the bedpan, the cushions 116 and 117 are fully inflated and the cushion 125 is completely deflated so that the bedpan can be placed on top of the cushion 125 with one end projecting underneath the cross band 122. After the patient has finished and the bedpan removed, cushions 116 and 117 are again deflated to air cushion level, while cushion 125 is again inflated to air cushion level. The use of three cushions makes for a more level air cushion support than obtained from the support device 10. Also, the width of cushion 124 is such that there is room for the bedpan between cushions 116 and 117. Other modifications of the invention are apparent, such as replacing the single cushion with a plurality of smaller cushions connected together and arranged horizontally or vertically of each other or both. The inflation of each such plurality of cushions could be accomplished from a single high pressure line under control of a single valve. Generally; the plurality of cushions would have the same longitudinal length as the single cushions which they replace. Also, in addition to compressed air, any other suitable gas or liquid (hot or cold) could be used to inflate the cushions.

What is claimed is:

1. A support device located on the bed of a patient for elevating patient for use of a bedpan comprising:

a flat flexible non-elastic base sheet resting on the bed;

tie means extending from opposite sides of said base sheet and connected with said bed for securing said base sheet;

at least a pair of cushions extending longitudinally of said base sheet, lengthwise of said bed;

means for securing each cushion to said base sheet at a longitudinal edge of each cushion;

the spacing between adjacent inside longitudinal edges of said two cushions when inflated being great enough to receive a bedpan therebetween; and means for individually inflating and deflating said pair of cushions.

2. A support device as defined in claim 1 wherein each of said cushions are secured to said base sheet along an outside longitudinal edge of each cushion, the distance between said adjacent inside edges of said cushions increasing as said cushions are inflated.

3. A support device as defined in claim 2:

a cover over said cushions and said base sheet, said cover comprising upper and lower draw sheets having adjacent edges located over said cushions, and means for fastening each draw sheet to said base sheet in the vicinity of said adjacent edges.

4. A support device as defined in claim 1:

a cross band extending transversely across said two cushions adjacent the head end thereof and having its two ends secured to said base sheet adjacent the outside edges of said two cushions; and said cross band being located to support the buttock and hip area of said patient and each of said two cushions being located to support a leg of said patient.

5. A support device as defined in claim 4 wherein said cross band is raised by said cushions to be higher than said bedpan when said two cushions are fully inflated in order to position the discharge area of the patient slightly beyond the lower edge of said cross band and over the bedpan.

6. A support device as defined in claim 4:

said cushions being secured to said base sheet along an outside longitudinal edge of each cushion, the distance between said inside edges of said cushions increasing as said cushions are inflated; and said cross band having slack therein when the cushions are fully deflated to permit movement of said cushions away from one another during inflation until said band becomes taut.

7. A support device as defined in claim 1 wherein:

said inflating and deflating means comprises separate valve means for said two cushions for inflating and deflating said cushions separately.

8. A support device as defined in claim 1 having:

a third inflatable cushion located transversely across said base sheet closely adjacent the head end of said two cushions and secured to said base sheet, said third cushion when inflated supporting the buttock and hip area of the patient at a height required for the patient to use the bedpan.

9. In the combination of claim 1, a second support device of the same construction as the first support device;

said second support device being turned over and inverted with respect to said first support device so that the base sheet of said second device is on top and the cushions of the second device rest on the bed;

said first and second devices being located on the bed so that the outside edges of the cross bands of the two devices are adjacent at approximately the center of the bed;

a first connection element on the upper surface of the base sheet of the second device and a second connection element on the outside edge of the cross band of the first device;

said elements being connected together to locate said second device in position to provide support for the back, shoulders and head of said patient; and means for individually inflating and deflating the pair of cushions of the second device.

10. The combination of claim 9, a cover over both said devices;

said cover comprising upper and lower draw sheets having adjacent edges secured to said first support device at approximately the center of said bed.

11. A support device as defined in claim 1 having:

a third cushion extending longitudinally of said base sheet over the base sheet surface between said pair of cushions;

means for securing said third cushion to said base sheet; and means for individually inflating and deflating said third cushion in order to deflate said third cushion for placing said bedpan thereon when said pair of cushions are fully inflated.

12. A support device as defined in claim 1 wherein:

said securing means being spaced apart on said base sheet a distance to separate said cushions and to place one cushion of each pair under each leg of said patient when the patient's legs are separated sufficiently for use of the bedpan.

13. A support device as defined in claim 12:

a draw sheet located over said cushion, means for fastening said draw sheet to said base sheet adjacent to the outside of said cushions, said draw sheet being of sufficient width between said fastening means to permit said draw sheet to be tucked under the inside edge of each of said cushions so as to tightly hug the cushions during inflation and deflation of the cushions.

14. A support device as defined in claim 13:

having fastener means under each of said cushions for securing the upper tucked edge of said draw sheet under each cushion.

* * * * *